US007053327B2

(12) United States Patent
Benke et al.

(10) Patent No.: US 7,053,327 B2
(45) Date of Patent: May 30, 2006

(54) APPARATUS AND METHOD FOR USE IN CIRCUIT INTERRUPTERS

(75) Inventors: James J. Benke, Pittsburgh, PA (US); Thomas K. Fogle, Pittsburgh, PA (US); Walter O. Jenkins, Pittsburgh, PA (US); Anthony T. Ricciuti, Pittsburgh, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/974,168

(22) Filed: Oct. 26, 2004

(65) Prior Publication Data

US 2006/0086694 A1 Apr. 27, 2006

(51) Int. Cl.
*H01H 33/66* (2006.01)

(52) U.S. Cl. ..... 218/154; 218/120; 218/140

(58) Field of Classification Search ..... 218/154, 218/153, 140, 120–124, 2, 7, 10, 14, 78, 218/84

See application file for complete search history.

(56) References Cited

U.S. PATENT DOCUMENTS 3,784,774 A * 1/1974 Wilson ..... 218/140
4,064,383 A 12/1977 Barkin
4,479,042 A * 10/1984 Basnett ..... 218/123
4,559,511 A * 12/1985 Basnett et al. ..... 335/132
4,743,876 A 5/1988 Milianowicz et al.
4,755,781 A * 7/1988 Bogner ..... 335/131
5,095,293 A 3/1992 Patel et al.
5,589,675 A * 12/1996 Walters et al. ..... 218/140
5,892,194 A * 4/1999 Uotome et al. ..... 218/68
6,002,560 A 12/1999 Nguyen et al.

* cited by examiner

*Primary Examiner*—Elvin Enad
*Assistant Examiner*—M. Fishman
(74) *Attorney, Agent, or Firm*—Martin J. Moran

(57) ABSTRACT

The present invention provides improved and more efficient methods and apparatus for maintaining and/or adjusting over-travel gaps and contact wipe portions in operating rod assemblies of circuit interrupters. According to one embodiment of the invention, a circuit interrupter comprises a fixed electrical contact; a moveable electrical contact; an operating rod assembly comprising at least one contact spring for imparting a corresponding opening or closing force to the contacts; a moveable contact stem operatively coupled between the moveable electrical contact and the operating rod assembly for positioning the moveable electrical contact into or out of engagement with the fixed electrical contact; and an adjustment member adjustably disposed on an opposite end of the circuit interrupter relative to the moveable electrical contact from the at least one contact spring; wherein motion of the operating rod assembly causes the moveable electrical contact to move into or out of engagement with the fixed electrical contact via motion of the moveable contact stem and wherein the moveable electrical contact moves into or out of engagement with the fixed electrical contact with application of force imparted by the contact spring, and wherein the adjustment member is capable of adjusting the force imparted by the contact spring when moving the moveable electrical contact into or out of engagement with the fixed electrical contact.

19 Claims, 9 Drawing Sheets

APPARATUS AND METHOD FOR USE IN CIRCUIT INTERRUPTERS

BACKGROUND

The present invention relates to electrical circuit interrupters, as well as positioning and adjustment of parts in such circuit interrupters.

Electrical distribution and protection equipment is an important element in many applications, particularly those employing medium to high electrical voltages. For example, one such type of equipment is a circuit breaker. Circuit breakers provide protection for electrical systems from electrical fault conditions such as current overloads, short circuits, and low level voltage conditions. Typically, circuit breakers include at least one circuit interrupter, which contains a spring-powered operating mechanism that opens electrical contacts in response to abnormal conditions in order to interrupt the current passing through the conductors in an electrical system. Circuit interrupters are an integral part of not only circuit breakers, but other types of electrical distribution and protection equipment as well.

One particular type of circuit interrupter is a vacuum circuit interrupter, which includes separable main contacts disposed within an insulated and hermetically sealed housing. During the past several decades, vacuum circuit interrupters have gained world-wide acceptance over other technologies for use in circuit breakers, contactors, motor starters, tap changers, distribution reclosers, metal-clad switchgear, and other electrical distribution and protection equipment. Depending on vacuum circuit interrupter construction, vacuum circuit interrupters offer one or more of the following advantages as compared to other types of circuit interrupters: (1) relatively long life due to controlled contact erosion, (2) relatively maintenance-free operation provided by enclosure of the contacts within the hermetically sealed housing, (3) excellent sticking resistance due to the use of hard contact materials, (4) relatively little or no atmospheric contact contamination, which contamination can detrimentally form oxides and corrosion layers on the contacts, (5) relatively little or no noise during operation due to containment of arcing within the hermetically sealed housing, (6) relatively few environmental effects as compared to those interrupters where current interruption does not occur in a vacuum and hence, where greenhouse or toxic gases can be freely emitted into the operating environment, and (7) very low current chop, resulting in a minimal induced transient voltage spike during circuit interruption so that surge suppressors are not required.

Generally, one of the contacts in a vacuum circuit interrupter is fixed relative to both the housing and to an external electrical conductor that is interconnected with the circuit controlled by the circuit interrupter. The other contact is moveable. In the case of a vacuum circuit interrupter, the moveable contact assembly usually comprises a stem of circular cross-section having the contact at one end enclosed within the vacuum chamber, and a driving mechanism at the other end which is external to the vacuum chamber. In one type of vacuum interrupter, an operating rod assembly is provided which carries a rotatable contact bell crank that is slideable on the operating rod and rotates about a pivot pin upon motion of the operating rod. This operating rod assembly is connected to the stem of the moveable contacts. The stem is typically affixed to a bellows seal that maintains the vacuum environment within the chamber while enabling movement of the stem and thus the moveable contact.

Motion of the operating rod assembly causes motion of the moveable contact into, or out of, engagement with the fixed contact.

The operating rod assembly is operatively connected to a latchable operating mechanism that is responsive to current. When an abnormal condition occurs, the latchable operating mechanism becomes unlatched, which causes the operating rod to move to the open position. The motion of the operating rod, in turn, causes the contact bell crank to rotate and, as described above, controls the motion of the moveable contact.

Contact springs are typically provided in the operating rod assembly in order to be able to separate the moveable contact from the fixed contact and to ensure the necessary force so that the contacts will not accidentally open under inappropriate conditions. In addition, when appropriate circumstances requiring interruption of the circuit do arise, an adequate force is needed to open the contacts with sufficient speed. If the contacts do not open quickly, there is a risk that the circuit interrupter will fail to interrupt the circuit.

In order to achieve the adequate interrupt speed and force, contact springs are mounted on the operating rod assembly. These contact springs are typically mounted towards one end of the operating rod between the moveable contact and the latchable operating mechanism to provide an over-travel gap (sometimes referred to as a "snatch" gap) or contact wipe portion within the operating rod assembly, a distance through which movement of the springs imparts the necessary speed and force for positioning of the moveable contact. The length of this over-travel gap, or contact wipe portion distance, is determined based on a measure of the force required to hold the vacuum interrupter contacts in a closed position (e.g., against counter forces caused by a peak momentary current). The length of the over-travel gap is also based upon the force required to open the contacts with sufficient speed for safe and clean interruption of an electrical circuit. Therefore, if such springs comprise compression springs, as is typically the case, it is important that the springs have sufficient compression during operation. On the other hand, if tension springs are utilized, adequate tension must exist.

In a typical case, the contact spring is held on the operating rod between a disk-spacer member that is carried along by the operating rod and a shoulder portion of a set of plates that are mounted at one end of the operating rod and spaced apart from the spacer member. When the contacts are closed, the operating rod travels toward its closed position. The plates are slideably mounted on the operating rod in such a way that when the contacts seat, motion of the plates stop. However, motion of the operating rod continues a further distance until it travels to its full extended position. At this point, the contact spring is fully compressed between the spacer member and the shoulder portion of the plates. The further distance traveled by the operating rod is referred to as the over-travel gap (also known as snatch gap) when the operating rod motion is essentially linear or contact wipe portion when the operating rod motion deviates in a non-linear manner with respect to the direction of opening and closing of the contacts. Generally non-linear operating rod motion is associated with those vacuum circuit interrupters that are encased within an open-air system (e.g., fastened to a box in a cantilever arrangement). Linear operating rod motion is associated with those vacuum circuit interrupters that are encased within a closed-air system (e.g., supported by encasement in molded epoxy or another similar material).

In order to ensure that appropriate compression (or tension) is imparted to the contact spring during operation, and hence providing the necessary forces associated with opening and closing the contacts, the over-travel gap is integrated into the circuit breaker design and maintained at a fixed distance. In one typical scenario, when adjustment is needed in order to maintain the fixed distance, repositionable shims are inserted in, removed from, or adjusted within a space residing between the lower end of the vacuum housing (e.g., the plastic bushing surface on the exterior of a vacuum bottle) and the upper end of a support frame (e.g., that provided by a crosshead drive rod or a pole unit support casting). Such shims are identified, for example, in U.S. Pat. No. 4,064,383. FIG. 2 therein illustrates the use of such shims (identified by reference numbers 79 and 80) in adjustment of over-travel gap distance. Special and multiple tools are often required, however, to pry and insert such shims when adjustment is needed. This method is not only cumbersome for users of the circuit breaker, but also ineffective at maintaining precise adjustment of the over-travel gap during operation.

Moreover, due to their repositionability, shims are capable of realigning themselves and even popping out of their intended positions during operation—and often do just that. Circuit breaker users are often ill-equipped to handle needed adjustment and hence vacuum interrupter circuit breakers operated as such often did not work as intended, or required frequent replacement due to the imprecise manner in which they were operated. While adjustment during a circuit breaker's operating life can be needed, due to settling of parts after manufacture and before initial use (e.g., during shipping), adjustment can also be required prior to initial use. In that case, the circuit breaker is adjusted after it reaches, and is positioned within, its destination of intended use.

Thus, more efficient techniques for maintaining or adjusting over-travel gaps and contact wipe portions in operating rod assemblies of circuit interrupters are needed. Not only is reliability desired in that regard, but ease of adjustment is also desired.

SUMMARY

The present invention provides improved and more efficient techniques for maintaining and/or adjusting over-travel gaps and contact wipe portions in operating rod assemblies of circuit interrupters. Such maintenance and adjustment is provided with relative ease as compared to conventional techniques and apparatus for the same.

According to one embodiment of the invention, a circuit interrupter comprises a fixed electrical contact; a moveable electrical contact; an operating rod assembly comprising at least one contact spring for imparting a corresponding opening or closing force to the contacts; a moveable contact stem operatively coupled between the moveable electrical contact and the operating rod assembly for positioning the moveable electrical contact into or out of engagement with the fixed electrical contact; and an adjustment member adjustably disposed on an opposite end of the circuit interrupter relative to the moveable electrical contact from the at least one contact spring; wherein motion of the operating rod assembly causes the moveable electrical contact to move into or out of engagement with the fixed electrical contact via motion of the moveable contact stem and wherein the moveable electrical contact moves into or out of engagement with the fixed electrical contact with application of force imparted by the contact spring, and wherein the adjustment member is capable of adjusting the force imparted by the contact spring when moving the moveable electrical contact into or out of engagement with the fixed electrical contact.

Depending on the application, such circuit interrupters can comprise an over-travel gap for imparting contact spring force. One exemplary over-travel gap is about 5.0 mm. In other applications, such circuit interrupters can comprise a contact wipe portion for imparting contact spring force. The contact spring can be a compression spring, a tension spring, or combinations thereof. In one exemplary embodiment, a circuit interrupter of the invention comprises two contact springs.

While variations are understood to be within the scope of the invention, in one embodiment of the invention the adjustment member comprises a conductive material. According to a further aspect of the invention, external threads on the adjustment member are received by a threaded adjustment member housing interposed between the adjustment member and the fixed electrical contact.

When the circuit interrupter is a vacuum circuit interrupter having a vacuum housing for enclosure of the fixed electrical contact and the moveable electrical contact, the adjustment member is coupled to the vacuum housing in a manner that facilitates longitudinal movement of the vacuum housing along a longitudinal axis shared with the adjustment member during adjustment according to an exemplary embodiment. The adjustment member can be coupled to the vacuum housing, for example, in a fixed manner using a cap screw. Further, the adjustment member can be secured (e.g., using a bearing locknut, such as one that threadably engages with the adjustment member housing) between adjustments.

Further to the vacuum circuit interrupter embodiment of the invention, such a circuit interrupter can comprise an over-travel gap for imparting contact spring force, wherein distance traveled by the vacuum housing during adjustment corresponds to adjustment of the over-travel gap by the same distance. While dimensions may vary depending on the application, an initial set dimension of about 30.5 mm can be provided between an upper surface of the adjustment member and an upper surface of the vacuum housing to facilitate adjustment latitude.

Circuit interrupters of the invention are useful in, among many larger assemblies and applications, electrical systems (e.g., a circuit breaker or larger systems employing circuit breakers). In one embodiment, a circuit breaker of the invention comprises a medium voltage vacuum circuit breaker.

Further assemblies comprising circuit interrupters of the invention include kits for maintaining desired force imparted by a contact spring when positioning a moveable electrical contact into or out of engagement with a fixed electrical contact in a circuit interrupter. In one embodiment, such a kit comprises, in addition to a circuit interrupter of the invention, a spanner wrench for locking and unlocking the bearing locknut and an adjustment spanner assembly for adjusting the adjustment member.

Methods of the invention include those for adjustment of force imparted by a contact spring when positioning a moveable electrical contact into or out of engagement with a fixed electrical contact in a circuit interrupter (e.g., a vacuum circuit interrupter). In this embodiment, the method comprises steps of providing an adjustment member adjustably disposed on an opposite end of the circuit interrupter relative to the moveable electrical contact from the at least one contact spring and adjusting the adjustment member (which is optionally secured between adjustments) in an amount necessary to obtain the desired force. The method can further comprise a step of unlocking the adjustment member prior to adjustment. Similarly, the method can further comprise a step of locking the adjustment member after adjusting the adjustment member in the amount necessary to obtain the desired force. For example, the adjustment member can be locked and unlocked using a spanner wrench. While many alternatives are within the scope of the invention, the adjustment member can be adjusted using an adjustment spanner assembly.

DETAILED DESCRIPTION

Figure 1:
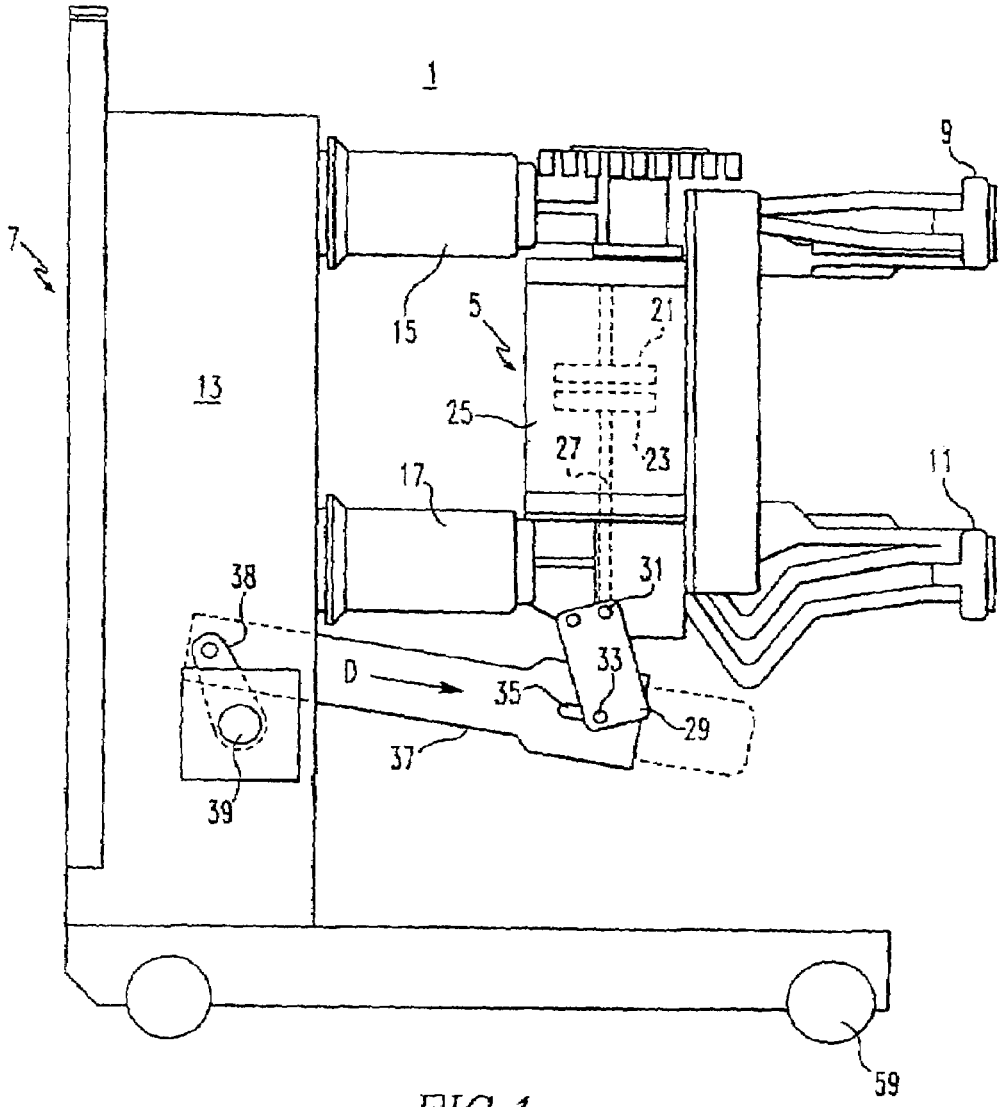
FIG.1 (PRIOR ART)
FIG. 1 is a side elevation view of a prior art circuit breaker having a vacuum interrupter assembly illustrating the basic operation of the assembly, a portion of which is applicable to this disclosure.

Referring to FIG. 1, there is illustrated a prior art circuit breaker 1 incorporating a vacuum interrupter assembly 5. The circuit breaker 1 illustrated is a drawn out three-phase vacuum circuit interrupter that has controls on the front panel 7 for manually operating the circuit breaker to either an open or closed condition. The circuit breaker 1 has conductive terminals 9 and 11 for one phase of the breaker and it has additional conductive terminals (not visible in FIG. 1) corresponding to the other two phases. Each phase employs its own vacuum circuit interrupter. The conductive terminals such as 9 and 11 are for contacting corresponding conductive terminals in an associated system that the circuit breaker is intended to control.

The circuit breaker 1 has a front low voltage portion 13 adjacent to the front panel 7 and a rear high voltage portion including the vacuum circuit interrupter assembly 5. The high and low voltage portions are electrically insulated from one another by upper and lower isolators 15 and 17, respectively. Vacuum circuit interrupter assembly 5 encloses a pair of separable contacts, including stationary contact 21 and moveable contact 23 within a vacuum housing 25. The circuit breaker illustrated in FIG. 1 is a prior art design, but many of the features such as those just described, and a major portion of the operating mechanism, are applicable to the subject invention, as well and are thus referenced throughout the detailed description below.

Details regarding the operating mechanism for moving the contacts 21 and 23 between an open and a closed circuit position are described in U.S. Pat. No. 4,743,876, which is herein incorporated by reference in its entirety. Briefly, as shown in FIG. 1, vacuum interrupter moveable contact stem 27 is suitably connected to a rotatable contact bell crank 29. Contact bell crank 29 is pivotally mounted at upper pin 31. Contact bell crank 29 is also rotatably mounted at lower pin 33. Pin 33 is slideably fastened in slot 35 of the operating rod 37. The operating rod 37 moves in response to the rotation of lever arm 38 about operating shaft 39. This motion occurs when a latchable operating mechanism (not shown in FIG. 1), more fully described in U.S. Pat. No. 4,743,876, is activated in response to, for example, an abnormal condition. When the operating rod 37 is placed in a closed position, the operating rod 37 moves generally horizontally in the direction D. Pin 33 slides in slot 35, also in a generally horizontal direction. Bell crank 29 rotates in an arc-shaped path and the vertical component of this arc-shaped motion acts to lift vacuum interrupter moveable contact stem 27, which moves moveable contact 23 until it seats against the fixed contact 21.

The operating linkage for opening the contacts 21 and 23, described in general terms, includes a trip latch having a series of links that are pivotally mounted with respect to the operating shaft 39 and the operating rod 37, such that when the trip latch falls from an initially upright position, the operating rod 37 recedes back toward the trip latch and the breaker 1 is then opened and moveable contact 23 is separated from fixed contact 21. A more thorough description is set forth in U.S. Pat. Nos. 5,095,293 and 4,743,876.

The foregoing description provides a general understanding of one embodiment of operation of the vacuum circuit interrupter and the operating mechanism that interfaces with the method and apparatus of the present invention. It is to be understood that variations in this embodiment do not depart from the spirit and scope of the invention as described more fully herein.

Note that components in the design illustrated in FIG. 1 may be shown with the same reference character primed in a later figure in order to highlight corresponding parts and minimize duplication in the description. For example, the operating mechanism shown generally in FIG. 2 by reference characters 38' and 39' corresponds to and is in all material respects for purposes of this disclosure similar to the lever arm 38 and operating shaft 39 shown in FIG. 1. Utilizing this format, although it may be identified in later figures, certain parts may be described only once with reference to the first figure in which they are shown.

Figure 2:
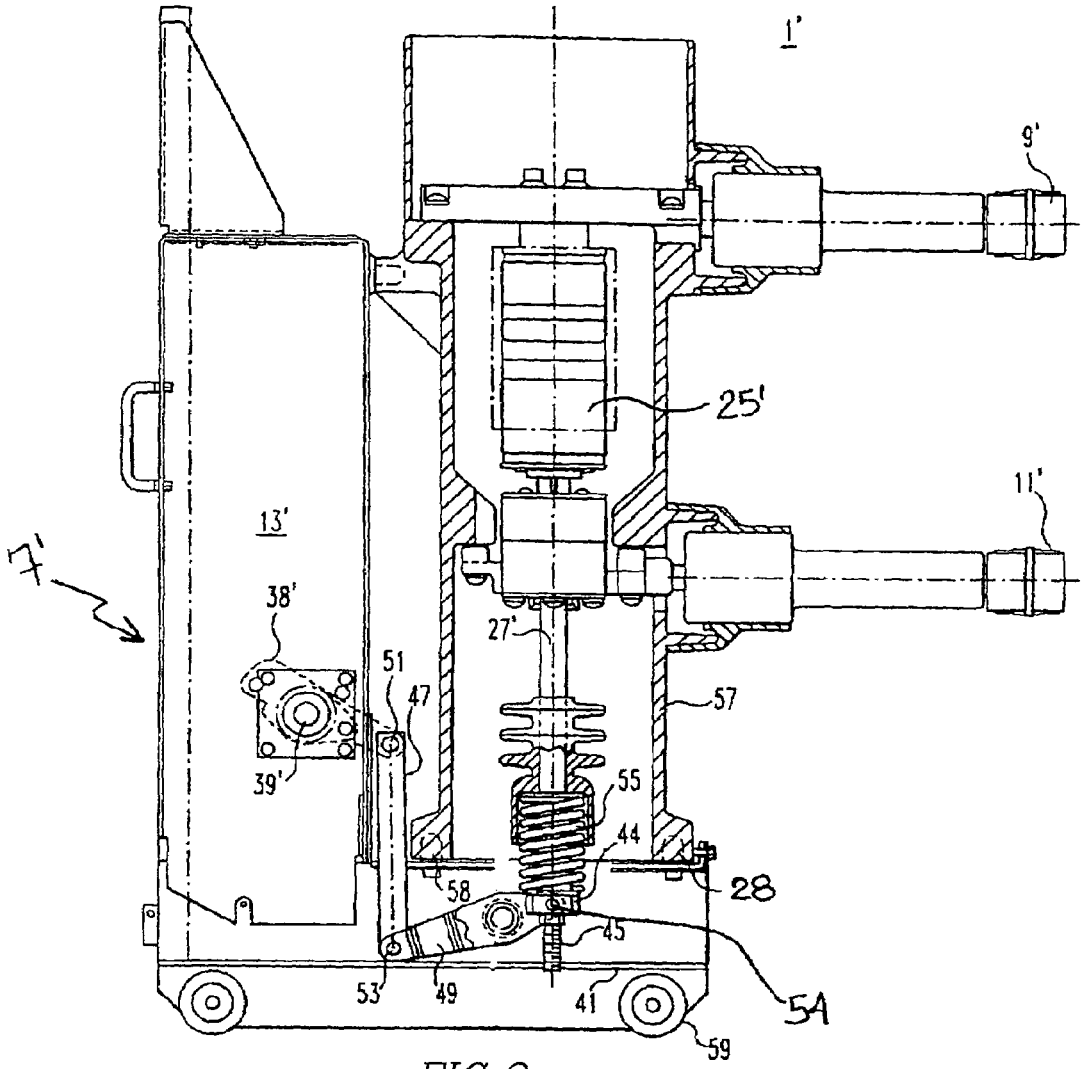
FIG. 2 is a side elevation view of a high voltage vacuum interrupter circuit breaker of the present teachings in the closed circuit position, wherein the circuit breaker employs another variation in the latchable operating mechanism illustrated in FIG. 1.

Within the more detailed vacuum interrupter assembly of FIG. 2, the lever arm 38' is connected by pin 51 to an operating arm having two linked components 47 and 49, which are pivotally connected by pin 53. The lower linkage 49 of the operating arm is similarly pivotally connected at its other end by pin 54 to an extended portion of the moveable contact stem 27' on the exterior side of the bellow seal that terminates in stud 45. Positioned over breaker pan 41, trunnion block 44 captures the contact spring 55 that is used to impart the necessary force to hold the contacts closed and open the moveable contact, which is not visible within the vacuum housing 25' shown in FIG. 2, but can be appreciated by reference to moveable contact 23 in FIG. 1. When the operating mechanism represented by reference characters 38' and 39' is in the latched position shown, the moveable contact is in the closed condition. A molded insulated housing 57 completely surrounds the vacuum interrupter and is anchored at locations 58 and 28. The insulation enables the vacuum interrupter carrying the high voltage portion of the unit to be supported much closer and in a much more compact arrangement (as compared to the prior art devices) with regard to the low voltage portion 13' and the exterior perimeter of the circuit breaker 1'. In this embodiment, isolators 15 and 17, used in the prior art device illustrated in FIG. 1, are replaced with support means that are built into the molded insulated housing 57, shown in FIG. 2.

Figure 3:
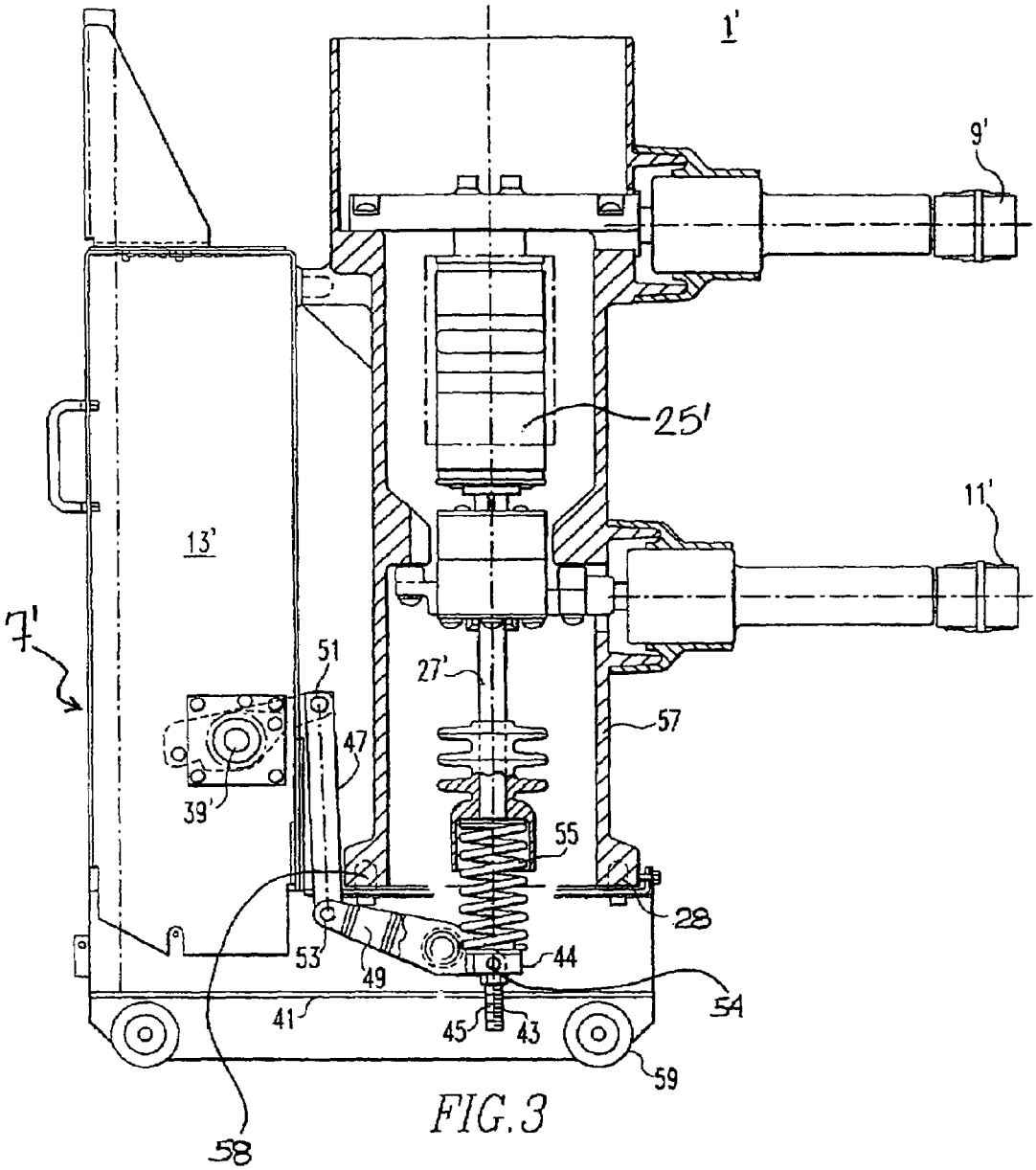
FIG. 3 is a side elevation view of the breaker shown in FIG. 2 with the vacuum interrupter assembly shown in the open circuit position.

FIG. 3 is identical, in most respects, to FIG. 2, except for moveable contact stem 27' and operating linkages 47 and 49 being shown in a position that opens the moveable contact within the vacuum housing 25'.

Figure 4:
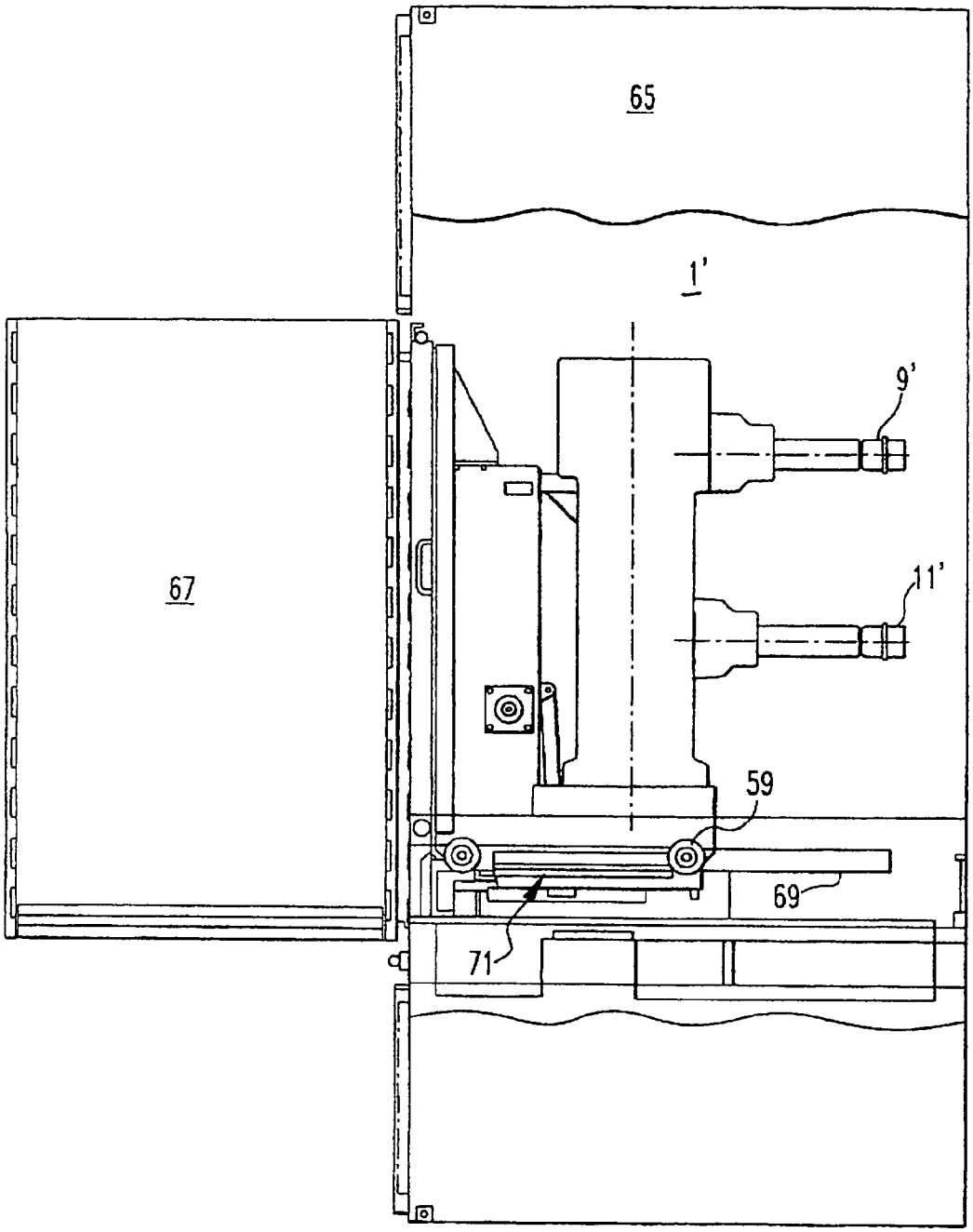
FIG. 4 is a side elevation partial cut away view of a breaker cabinet with a breaker designed in accordance with FIGS. 2 and 3 partially in place on its rails and engaged with its levering in and support components therein.

FIG. 4 shows the breaker 1', previously illustrated in FIGS. 2 and 3, partially engaged within a larger breaker cabinet 65. A portion of the outside cabinet wall is shown broken away to better appreciate the insertion mechanism used to drive the breaker 1' through the cabinet door 67 and fully seat the conductive terminals 9' and 11' in engagement with a bus bar and load contact supported along the rear of the cabinet 65. The wheels 59 of the breaker 1' ride on guide rail 69 and the undercarriage of the breaker 1' engages a captured ball housing component of a crank, screw and captured ball design, within the cabinet breaker support structure 71, that is employed to drive the breaker drawer into and out of the cabinet 65. It should be appreciated that when the breaker 1' is inserted or withdrawn from the cabinet 65, the contacts are generally in the open position to avoid arcing of the conductive terminals 9' and 11' that mate with the corresponding contacts on the bus and load.

Figure 5:
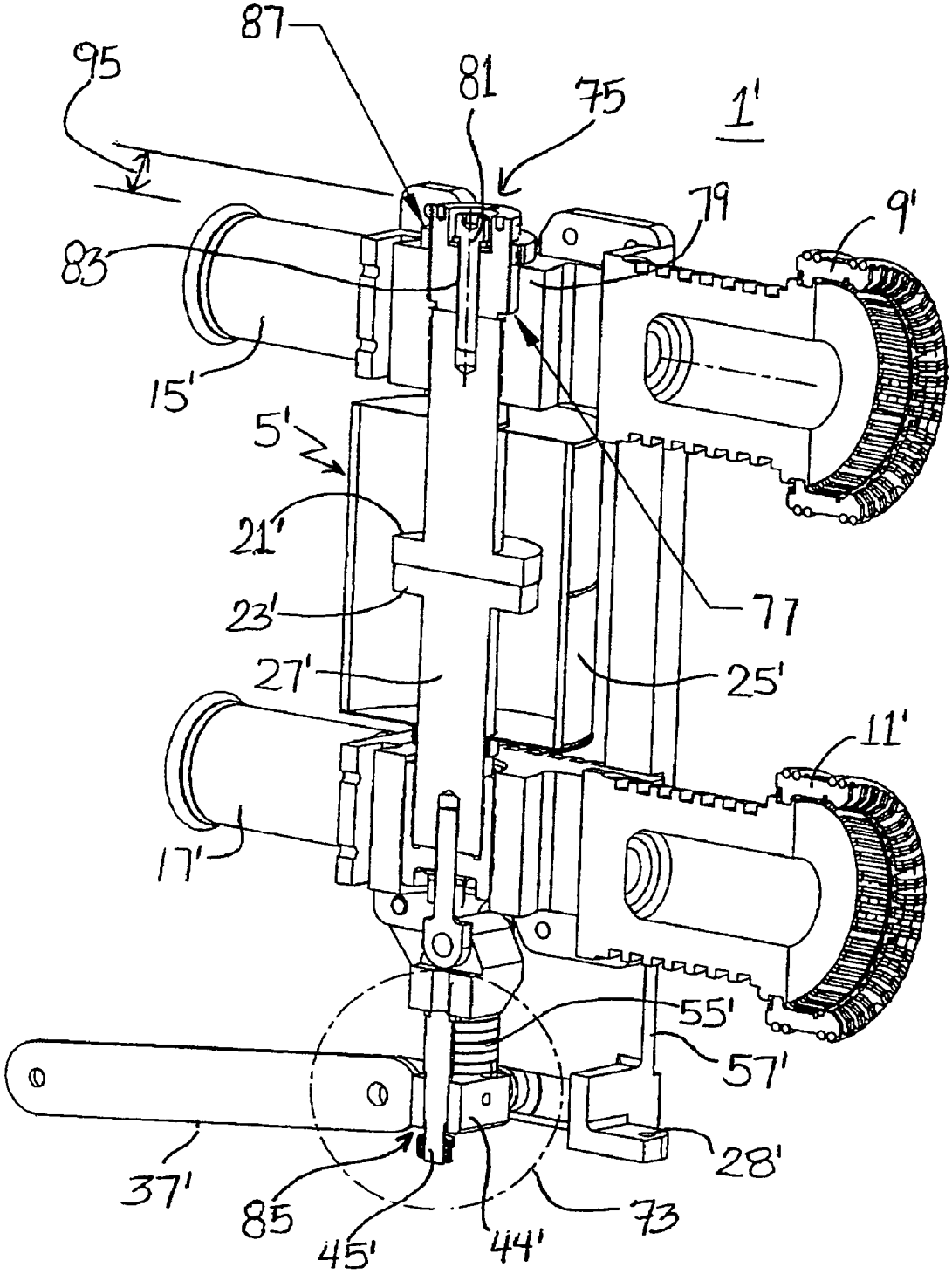
FIG. 5 is a side elevation partial cut away view of a circuit breaker according to the present teachings, wherein parts associated with adjustment of an over-travel gap therein are shown.
Figure 6:
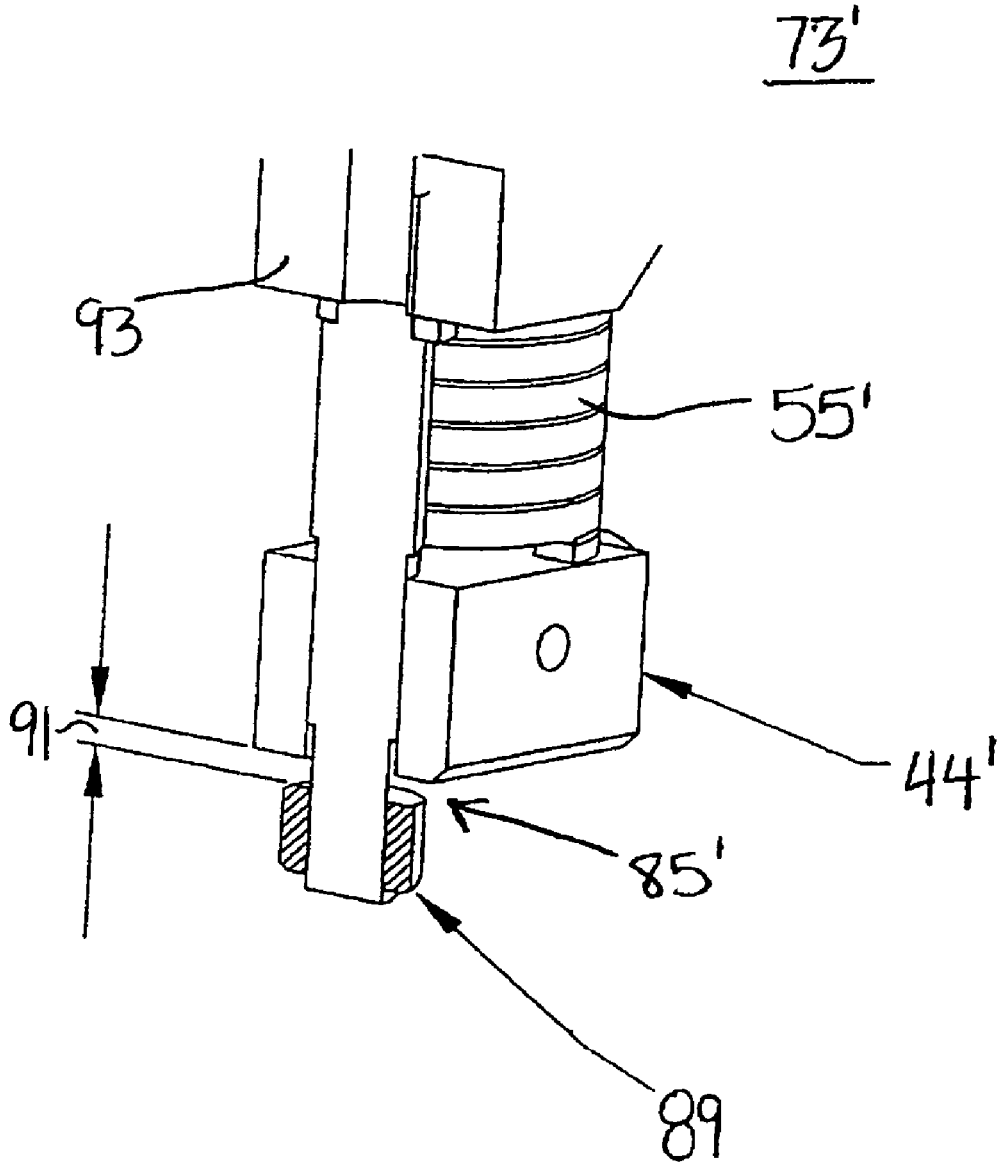
FIG. 6 is an enlarged side elevation partial cut away view of the over-travel gap within the breaker of FIG. 5.

In accordance with the present teachings, an over-travel gap portion 73 of one embodiment of an improved circuit breaker 1' is illustrated in FIGS. 5 and 6. Further illustrated in FIG. 5 is an over-travel gap adjustment portion 75 of the circuit breaker 1'. In an exemplary embodiment of the invention, over-travel gap portion 73 and over-travel gap adjustment portion 75 are disposed on opposite ends of the breaker 1' relative to the contacts 21' and 23'.

Optimally, adjustment of the over-travel gap occurs when the contacts 21' and 23' are in the closed position. To facilitate such adjustment, an adjustment member 77 is moveably engaged within adjustment member housing 79 adjacent conductive terminal 9'. In one embodiment, adjustment member housing 79 comprises an internally threaded housing adapted for receiving an externally threaded portion of the adjustment member 77. In this embodiment, threads on the adjustment member 77 and adjustment member housing 79 have a similar size and pitch with respect to one another. In one embodiment, the threads are of nominal size (e.g., M65), and have a pitch of about 2 mm. When threads of this size are used, one-quarter rotation of the adjustment member 77 provides longitudinal movement of the adjustment member 77 along a longitudinal axis 81 in an amount of approximately 0.5 mm. It should be noted that threads of different sizes and pitch can be utilized in order to obtain an adjustment having a desired resolution.

In the embodiment illustrated in FIG. 5, the adjustment member housing 79 is coupled to the vacuum housing 25' in a manner that facilitates longitudinal movement of the vacuum housing 25' of a distance equivalent to the longitudinal distance that is traveled by the adjustment member 77 within the adjustment member housing 79 along the shared longitudinal axis 81. Thus, upward or downward movement of the adjustment member 77 results in movement of the vacuum housing 25' with respect to the contacts 21' and 23' contained within. This longitudinal movement translates into an adjustment of the over-travel gap 85 within the circuit breaker 1' by the same distance. Although it is desirable to couple these parts in a manner that facilitates similar movement (e.g., both in terms of direction and distance) in adjacent parts, such as in the embodiment described with reference to FIG. 5, variations in the arrangement of the parts within the adjustment portion 75 and the corresponding effect on overall operation can be made without departing from the spirit and scope of the present invention.

As long as the adjustment member housing 79 and the vacuum housing 25' are coupled in a manner that promotes precisely calculated movement of vacuum housing 25' in response to movement of adjustment member housing 79, any suitable mechanism and/or fixture for engagement of the two parts can be utilized. For example, mechanical or chemical fastening mechanisms can be used to fixedly couple the vacuum housing 25' with the adjustment member housing 79. In an exemplary embodiment, the adjustment member housing 79 is coupled to the vacuum housing 25' in a fixed manner using a cap screw 83. For example, the cap screw 83 can comprise a standard M16×75 mm cap screw.

Still referring to FIG. 5, when not being used for adjustment purposes, the adjustment member 77 is secured to prevent unintended rotation within the adjustment member housing 79. In one embodiment, a bearing locknut 87 is used for this purpose. When adjustment is required, the bearing locknut 87 is unlocked before, and then locked again, after the over-travel gap adjustment is performed in accordance with the present teachings.

Each of the parts described with respect to the present inventive improved circuit interrupter can be formed using any suitable material or combinations thereof. In one embodiment, the adjustment member housing 79 comprises a conductive material such as, for example, copper. While the entire adjustment member housing 79 need not comprise a conductive material, generally parts of the circuit breaker 1' are fabricated and selected so as to provide a continuous conductive path between the conductive terminals 9' and 11', and through the contacts 21' and 23' when the improved circuit breaker 1'is closed. Similarly, in one embodiment, the adjustment member 77 comprises a conductive material such as, for example, copper. However, as with the adjustment member housing 79, any suitable material or combinations thereof can be used as long as a continuous conductive path resides between the conductive terminals 9' and 11' and through the contacts 21' and 23' in the circuit breaker 1' when operated in the closed circuit position. In order to promote continuity, the presence of joints at the intersection of adjoining parts are minimized in such conductive paths according to exemplary embodiments of the invention. When the presence of joints is necessary, conductive lamination can be used to help facilitate uninterrupted conduction through the joint.

Depending on the materials used in implementing the various parts within the over-travel gap adjustment portion 75, safety precautions may be necessary by one performing the over-travel gap adjustment. For example, electrical power should be turned off to circuit breaker 1' prior to performing an adjustment. As an added precaution, insulated gloves or other safety apparatus can be worn by one performing the adjustment.

With reference to FIG. 6, the over-travel gap portion 73' of the breaker 1' of FIG. 5 is shown in more detail. An over-travel gap 85' is defined between the lower end of the trunnion block 44' and an upper end of a fixture such as the cap screw 89. For example, the cap screw 89 can comprise a standard M16×75 mm cap screw. It is to be understood that type and arrangement of parts contained within the over-travel gap portion 73' of a circuit breaker can vary without departing from the spirit and scope of the present invention. Those illustrated in FIG. 6 are associated merely within an exemplary embodiment of the invention, one where an over-travel gap is present within a breaker assembly. When a contact wipe mechanism is used as an alternative to the over-travel gap mechanism illustrated in FIG. 6, for example, the parts and corresponding arrangement will vary as known to those of skill in the art. The invention applies to an adjustment of all such mechanisms that facilitate proper opening and closing of contacts within a circuit interrupter.

As further illustrated in FIG. 6 with reference to length 91 and the embodiment so illustrated, over-travel gap distance is selected for a particular circuit breaker based on the force required to keep the vacuum interrupter contacts closed when desired. The over-travel gap distance is also based upon the force required to open the contacts with sufficient speed for safe and clean interruption of an electrical circuit when, for example, an abnormal electrical condition is encountered that triggers the opening of the circuit. The contact spring 55' that comprises part of the circuit breaker must provide the force necessary to hold the contacts closed against the peak momentary current. The contact spring 55' must also provide the necessary force to pry the contacts open again with appropriate speed. Therefore, if the contact spring 55' is a compression spring, as is typically the case, it is important that the contact spring 55' have sufficient compression during operation. On the other hand, if a tension spring is utilized, adequate tension must exist in the spring during operation. When the contacts within an operatively connected vacuum housing are closed, the contact spring 55' is further compressed (or tensioned) during travel of the operating rod after initial connection of the contacts is made during closure. While one contact spring 55' is illustrated in this embodiment, more than one contact spring may be used for this purpose in alternate embodiments.

Medium voltage vacuum circuit interrupters are generally those operating in conjunction with rated currents of between 1,000 Volts and 38,000 Volts (and even up to 40,000 Volts in certain parts of the world). High voltage vacuum circuit interrupters are generally those operating in conjunction with rated currents of about 40,000 Volts and greater.

An exemplary embodiment of the invention comprises a medium voltage vacuum circuit interrupter. While not dispositive, generally medium voltage vacuum circuit interrupters are designed to work well with an over-travel gap of approximately 0.5 mm (0.02 inches) and higher. In one embodiment of a medium voltage vacuum circuit interrupter of the invention, the over-travel gap distance 91 is approximately 5.0 mm (0.20 inches). This distance is typically deemed sufficient to impart the necessary forces associated with the opening and closing of the contacts in an 80 kA 4,000 Ampere vacuum circuit interrupter. During typical operation, such a vacuum circuit interrupter has a distance between contacts, when in the fully open position, of approximately 11.0 mm (0.43 inches) in one embodiment. This distance is known as the "stroke" of a vacuum circuit interrupter. The combined length of the over-travel gap 91 and the stroke is the total distance that the operating rod travels when moving the contacts between fully closed and fully opened positions.

Based on the "stroke" length, and voltage characteristics of a vacuum circuit interrupter, the over-travel gap 91 is adjusted accordingly as known to those of skill in the circuit breaker art. Thus, the over-travel gap can have a length from just above 0 mm to as great as necessary to assist in breaking apart the contacts during interruption and minimize potential weldment of the contacts.

As further illustrated in the embodiment shown in FIG. 6, contact spring 55' is axially coupled with an extension of the moveable contact stem 27' between the spacer member 93 carried along by the moveable contact stem 27' and the trunnion block 44' that is spaced apart from the spacer member 93. With reference to both FIG. 5 and FIG. 6, when the contacts of the circuit breaker 1' are closed from an open circuit position, the moveable contact stem 27' travels upwards toward its closed circuit position. After the moveable contact stem 27' travels a distance Y, the contacts 21' and 23' seat, and motion of the spacer member 93 stops. However, motion of the moveable contact stem 27' continues a further distance 91 (i.e., length of the over-travel gap) until it is in its farthest upward position. At this point, the contact spring 55' is fully charged (e.g., compressed) between the spacer member 93 and the trunnion block 44'. Note that any suitable parts may be used, as known to those skilled in the circuit breaker art, to provide an over-travel gap, or similar structure, within a circuit interrupter for use with the adjustment mechanism of the present invention.

When the contacts of the circuit breaker 1' are opened from a closed circuit position, the moveable contact stem 27' travels the over-travel gap distance 91 upon opening before the fixed and moveable contacts 21' and 23' begin to move apart from one another. During this initial travel, stored energy in the contact spring 55' is transferred to the moveable contact stem 27', giving the moveable contact stem 27' kinetic energy sufficient to provide the force necessary to break apart the contacts. Thus, with continuing movement, the moveable contact 23' engages and joins with the moveable contact stem 27' in descending from the fixed contact 21' to its full open circuit position. The over-travel gap 85' facilitates an effective opening of the contacts by providing for release of equivalent stored energy in the contact spring 55' to break apart any welds formed between the closed contacts 21' and 23'.

According to an exemplary embodiment, an initial set dimension of approximately 30.5 mm (1.2 inches), shown as a distance 95 in FIG. 5, is provided between an upper surface of the adjustment member 77 and an upper surface of the adjustment member housing 79. This distance provides latitude in proper positioning and adjustment of the over-travel gap 85. Adjustments are made as needed during operation. For example, one may choose to verify and adjust the over-travel gap 85 at predetermined time intervals during operation to ensure reliable performance of the improved circuit breaker 1'. Further, one may choose to adjust the over-travel gap 85 after triggering of certain events such as events known to cause contact erosion. Contact erosion can detrimentally impact the over-travel gap distance 91, preventing the circuit interrupter from having the full benefit of a mechanism such as an over-travel gap 85. As understood by those of skill in the circuit breaker art, indicators can be used in further embodiments of the invention in order to assist in determining when adjustments are likely to be beneficial.

Figure 7:
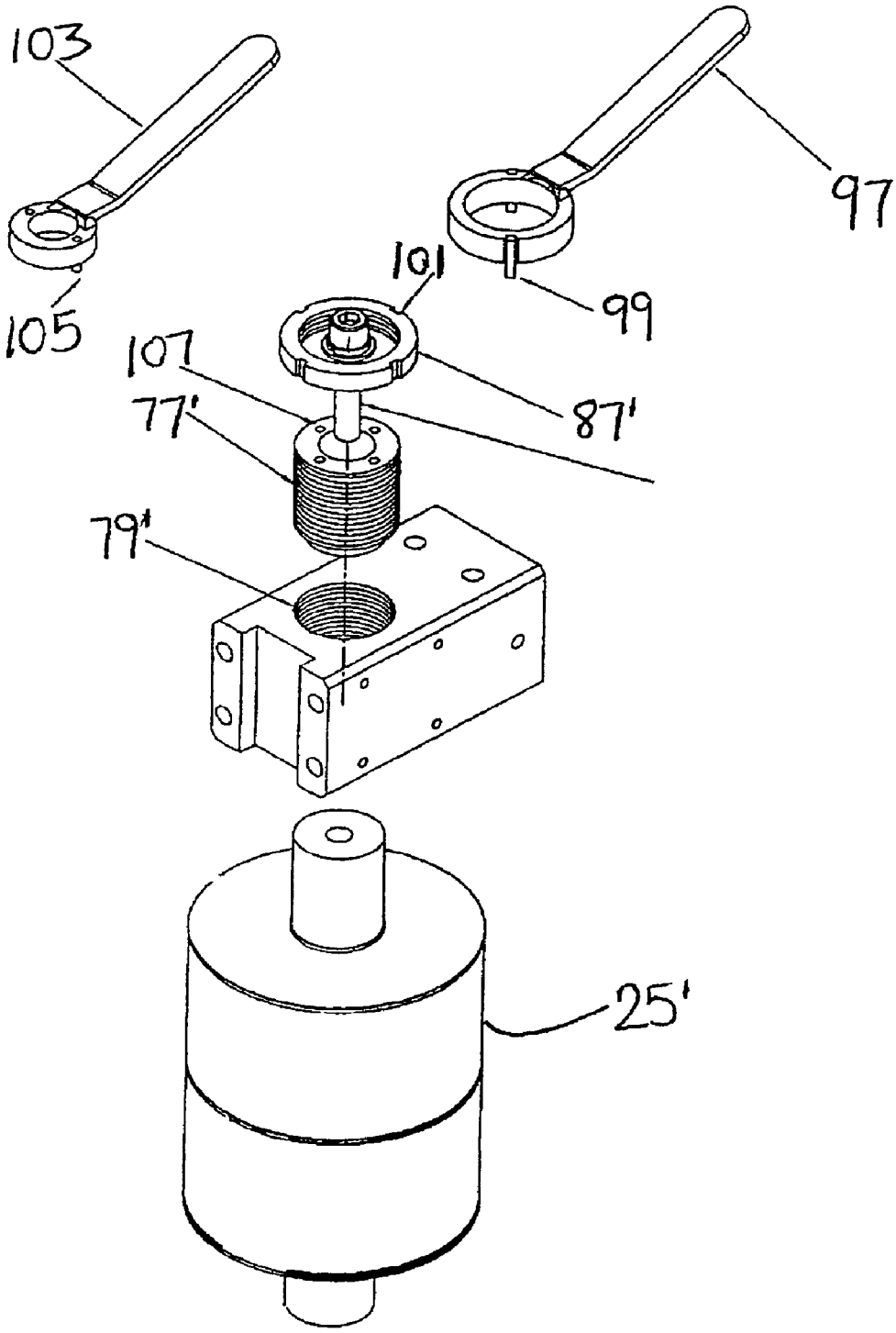
FIG. 7 is an exploded assembly view of the circuit breaker and parts associated with adjustment of the over-travel gap within the circuit breaker assembly of FIG. 5 illustrated therein.

To unlock and rotate the bearing locknut 87 when performing an adjustment, any suitable tools may be used. In one embodiment, as illustrated in FIG. 7, a spanner wrench 97 is used to unlock the bearing locknut 87'. In this exemplary embodiment, pegs 99 on the spanner wrench 97 are aligned with similarly shaped slots 101 on the bearing locknut 87' to engage the bearing locknut 87' for this purpose. The bearing locknut 87' is then unlocked by rotating the spanner wrench 97 in an appropriate direction and by an appropriate number of revolutions.

Once the bearing locknut 87' is unlocked, the adjustment member 77' is rotated the appropriate number of revolutions to obtain the over-travel gap adjustment needed or desired. In the embodiment illustrated in FIG. 7, an adjustment spanner assembly 103 is used for this purpose. In this exemplary embodiment, pegs 105 on the adjustment spanner assembly 103 are aligned with similarly shaped holes 107 on the adjustment member 77' to engage the adjustment member 77' for rotation. The adjustment member 77' is then rotated within the adjustment member housing 79'. After the desired adjustment is made, bearing locknut 87' is then locked within the adjustment member 77' using the spanner wrench 97.

Figure 8:
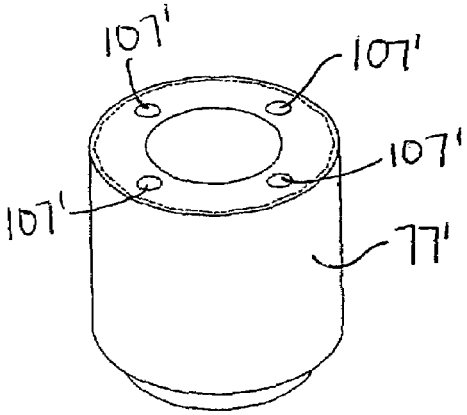
FIG. 8 is a side elevation view of the adjustment member within the circuit breaker assembly illustrated in FIG. 7.
Figure 9:
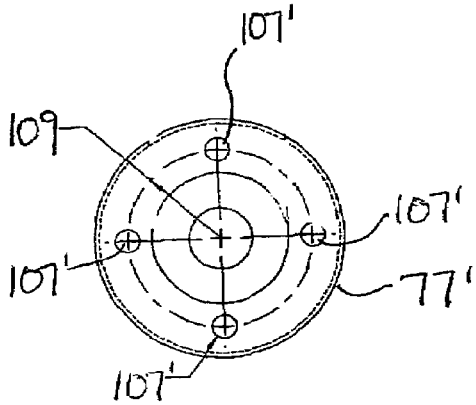
FIG. 9 is top plan view of the adjustment member within the circuit breaker assembly in FIG. 7.
Figure 10:
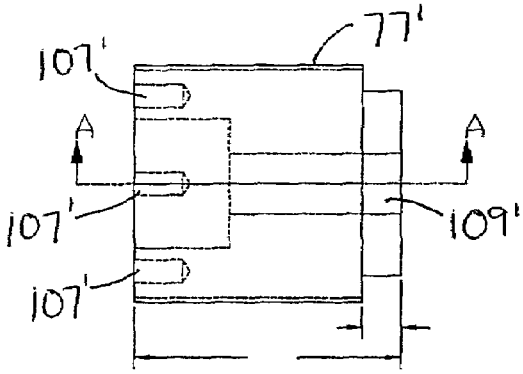
FIG. 10 is side plan view of the adjustment member within the circuit breaker assembly illustrated in FIG. 7.
Figure 11:
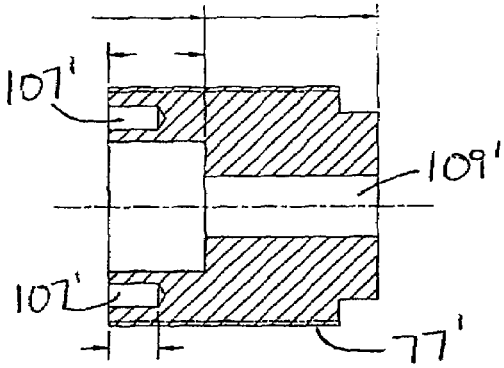
FIG. 11 is a cross-sectional view of the adjustment member illustrated in FIG. 10 taken along line A–A.

FIGS. 8–11 illustrate further details of the adjustment member 77' in several different views. Each of four holes 107' adapted to receive the adjustment spanner assembly 103 illustrated in FIG. 7, are referenced in FIGS. 8–11. FIG. 8 illustrates a side elevation view of the adjustment member 77'. FIG. 9 illustrates a top plan view of the adjustment member 77' with a hole 109 adapted for insertion of a cap screw 81 therethrough as shown in the embodiment illustrated in FIG. 5. FIG. 10 illustrates a side plan view of one embodiment of the adjustment member 77' and FIG. 11 illustrates a cross-sectional view of the adjustment member 77' of FIG. 10. It is to be understood that other suitable tools and parts can be used in conjunction with locking and unlocking the over-travel gap adjustment mechanism. For example, the number and shape of holes for insertion of tools in the adjustment member 77' and the bearing locknut 87' can be modified without departing from the spirit or scope of the present invention. Further, holes in each of these parts may not be necessary depending on the overall circuit interrupter design and tools used for over-travel gap adjustment therein.

As noted above, in order to determine when over-travel gap adjustment is needed or beneficial, indicators such as those described in U.S. Pat. Nos. 5,095,293 and 6,002,560, for example, can be used to test spring compression (or tension) and determine whether it is adequate. Adequate spring compression is, in one respect, an indication of the contacts being in acceptable condition. This is because worn contacts that require a greater degree of travel by the moving stem in the embodiments described above, which means that the compression of the contact spring is diminished. With less compression, less energy is stored in the contact spring and hence, adequate force may not be obtained for opening and closing the contacts as desired.

Figure 12:
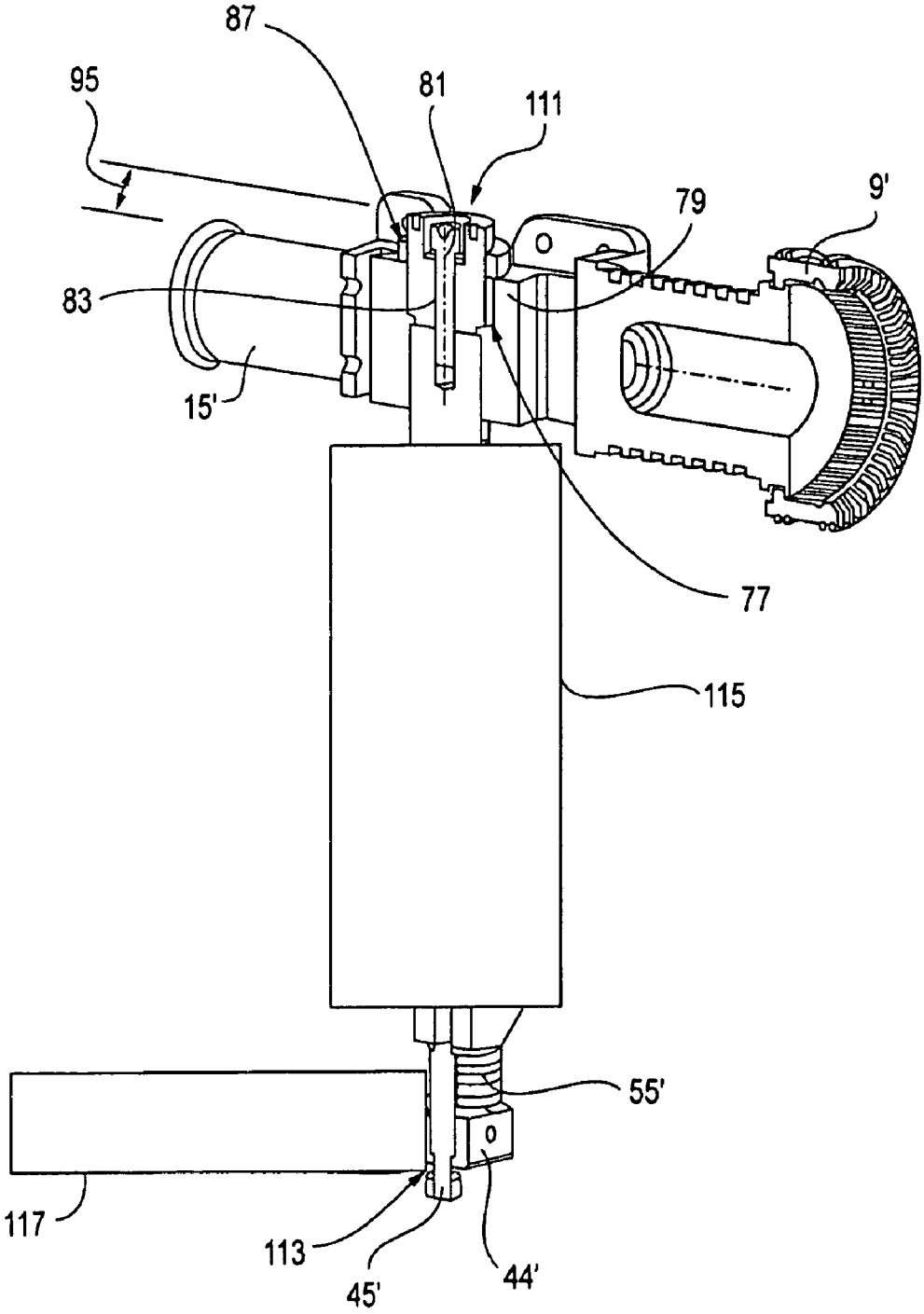
FIG. 12 is a side elevation partial cut away view of another embodiment of a circuit breaker according to the present teachings, wherein parts associated with adjustment of a contact wipe portion therein are shown.

Various modifications and alterations of the invention will become apparent to those skilled in the circuit breaker art without departing from the spirit and scope of the present invention, which is defined by the accompanying claims. For example, while reference is made throughout to over-travel gap adjustment in circuit breakers, the present invention is similarly applicable to adjustment of contact wipe portions of circuit breakers employing such mechanisms in the alternative, or in addition to over-travel gap mechanisms for similar purposes. FIG. 12 shows an embodiment of a circuit breaker according to the present teachings wherein contact wipe portions of circuit breakers are adjusted. A contact wipe portion 113 illustrated therein is analogous to the over-travel gap 85 and 85' described above with reference to FIGS. 5 and 6 and is defined between the lower end of the trunnion block 44' and the upper end of a fixture such as a cap screw on stud 45'. Further, similar to the function and operation of the over-travel gap adjustment portion 75 described above with reference to FIG. 5, a contact wipe portion adjustment member 111 facilitates the adjustment of the contact wipe portion 113 in FIG. 12. Functional blocks are used to illustrate conventional sections of the circuit breaker. More specifically, the conventional section of the circuit breaker that includes fixed and moveable contacts is represented by functional block 115. The conventional section of the circuit breaker that includes the operating mechanism is represented by functional block 117. Further, the invention is applicable not only to circuit breakers, but also to any other apparatus employing a circuit interrupter. As noted in the background, a wide variety of electrical distribution and protection equipment utilizes electrical circuit interrupters. Vacuum circuit interrupters are useful in, for example, contactors, motor starters, tap changers, distribution reclosers, metal-clad switchgear, and other equipment. The appended claims are to be construed accordingly. It should also be noted that steps recited in any method claims below do not necessarily need to be performed in the order that they are recited. Those of ordinary skill in the art will recognize variations in performing the steps from the order in which they are recited.

What is claimed is:

1. A circuit interrupter comprising:

a fixed electrical contact;

a moveable electrical contact;

an operating rod assembly comprising at least one contact spring for imparting a corresponding opening or closing force to the contacts;

a moveable contact stem operatively coupled between the moveable electrical contact and the operating rod assembly for positioning the moveable electrical contact into or out of engagement with the fixed electrical contact; and an adjustment member adjustably disposed on an opposite end of the circuit interrupter relative to the moveable electrical contact from the at least one contact spring;

wherein external threads on the adjustment member are received by a threaded adjustment member housing interposed between the adjustment member and the fixed electrical contact;

wherein motion of the operating rod assembly causes the moveable electrical contact to move into or out of engagement with the fixed electrical contact via motion of the moveable contact stem and wherein the moveable electrical contact moves into or out of engagement with the fixed electrical contact with application of force imparted by the contact spring, and wherein the adjustment member is capable of adjusting the force imparted by the contact spring when moving the moveable electrical contact into or out of engagement with the fixed electrical contact.

2. The circuit interrupter of claim 1, comprising an over-travel gap for imparting contact spring force.

3. The circuit interrupter of claim 2, wherein the over-travel gap is about 5.0 mm.

4. The circuit interrupter of claim 1, comprising a contact wipe portion for imparting contact spring force.

5. The circuit interrupter of claim 1, wherein the at least one contact spring comprises a compression spring.

6. The circuit interrupter of claim 1, wherein the at least one contact spring comprises a tension spring.

7. The circuit interrupter of claim 1, comprising two contact springs.

8. The circuit interrupter of claim 1, wherein the circuit interrupter comprises a vacuum circuit interrupter.

9. The circuit interrupter of claim 1, wherein the circuit interrupter comprises a vacuum circuit interrupter having a vacuum housing for enclosure of the fixed electrical contact and the moveable electrical contact and wherein the adjustment member is coupled to the vacuum housing in a manner that facilitates longitudinal movement of the vacuum housing along a longitudinal axis shared with the adjustment member during adjustment.

10. The circuit interrupter of claim 9, wherein the adjustment member is coupled to the vacuum housing in a fixed manner using a cap screw.

11. The circuit interrupter of claim 9, comprising an over-travel gap for imparting contact spring force, and wherein distance traveled by the vacuum housing during adjustment corresponds to adjustment of the over-travel gap by the same distance.

12. The circuit interrupter of claim 9, wherein an initial set dimension of about 30.5 mm is provided between upper surface of adjustment member and upper surface of vacuum housing.

13. The circuit interrupter of claim 1, wherein the adjustment member is secured between adjustments.

14. The circuit interrupter of claim 13, wherein the adjustment member is secured using a bearing locknut.

15. The circuit interrupter of claim 14, wherein the bearing locknut threadably engages with the adjustment member housing.

16. The circuit interrupter of claim 1, wherein the adjustment member comprises a conductive material.

17. A circuit breaker comprising the circuit interrupter of claim 1.

18. The circuit breaker of claim 17, wherein the circuit breaker comprises a medium voltage vacuum circuit breaker.

19. An electrical system comprising the circuit interrupter of claim 1.

* * * * *